US012137860B2

(12) United States Patent
Reunanen et al.

(10) Patent No.: US 12,137,860 B2
(45) Date of Patent: Nov. 12, 2024

(54) DISHWASHER WITH IMPROVED DETERGENT DISPENSER

(71) Applicant: Electrolux Appliances Aktiebolag, Stockholm (SE)

(72) Inventors: Kristian Reunanen, Stockholm (SE); Ivar Siösteen, Värmdö (SE); Stefano Stefani, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 312 days.

(21) Appl. No.: 17/610,907

(22) PCT Filed: May 23, 2019

(86) PCT No.: PCT/EP2019/063279
§ 371 (c)(1),
(2) Date: Nov. 12, 2021

(87) PCT Pub. No.: WO2020/233811
PCT Pub. Date: Nov. 26, 2020

(65) Prior Publication Data

US 2022/0211246 A1 Jul. 7, 2022

(51) Int. Cl.
*A47L 15/44* (2006.01)
*A47L 15/42* (2006.01)
*A47L 15/46* (2006.01)

(52) U.S. Cl.
CPC ..... *A47L 15/44* (2013.01); *A47L 15/4214* (2013.01); *A47L 15/4257* (2013.01); *A47L 15/46* (2013.01)

(58) Field of Classification Search
CPC .. A47L 15/4214; A47L 15/4257; A47L 15/44; A47L 15/4409; A47L 15/4418;
(Continued)

(56) References Cited

U.S. PATENT DOCUMENTS 4,735,228 A 4/1988 Boedecker et al.
5,186,912 A 2/1993 Steindorf et al.
(Continued)

FOREIGN PATENT DOCUMENTS

CN 107616772 A 1/2018
CN 110693416 A 1/2020
(Continued)

OTHER PUBLICATIONS

International Search Report and Written Opinion for International Application No. PCT/EP2018/086678, dated Aug. 23, 2019, 13 pages.
(Continued)

*Primary Examiner* — David G Cormier
(74) *Attorney, Agent, or Firm* — Bradley Arant Boult Cummings LLP

(57) ABSTRACT

A dishwasher having a water pump, a water conduit connected to the water pump for distributing water in the dishwasher tub, a door for closing and opening the dishwasher, and a detergent dispenser located on the inside of the door. The detergent dispenser comprises a closeable cavity for receiving a detergent, an outlet into the tub, and a sealed dispenser water inlet configured to be detachably connected to the water conduit when the door is closed. Operation of the pump causes pressurized water to be directed directly to the inside of the detergent dispenser while the detergent dispenser is in a closed state.

19 Claims, 8 Drawing Sheets

(58) Field of Classification Search
CPC ..... A47L 15/4436; A47L 15/4463; A47L 15/449; A47L 15/46
See application file for complete search history.

(56) References Cited

U.S. PATENT DOCUMENTS

| | | | | |
|---|---|---|---|---|
| 5,483,989 | A * | 1/1996 | Lim | A47L 15/4436 137/268 |
| 5,603,431 | A | 2/1997 | Tuller | |
| 6,622,896 | B2 | 9/2003 | Hegeman et al. | |
| 6,773,668 | B1 | 8/2004 | Everson et al. | |
| 7,275,552 | B2 | 10/2007 | DeWeerd et al. | |
| 7,475,696 | B2 | 1/2009 | Vanderroest et al. | |
| 8,608,866 | B2 | 12/2013 | Francisco et al. | |
| 9,034,114 | B2 | 5/2015 | Bertsch et al. | |
| 9,392,924 | B2 | 7/2016 | Bertsch et al. | |
| 9,861,257 | B2 | 1/2018 | Durham et al. | |
| 10,117,561 | B2 | 11/2018 | Kan et al. | |
| 10,413,153 | B2 | 9/2019 | Detko | |
| 2005/0045672 | A1 | 3/2005 | Marone | |
| 2005/0126607 | A1 | 6/2005 | Haft et al. | |
| 2005/0126608 | A1* | 6/2005 | DeWeerd | A47L 15/4436 134/57 D |
| 2005/0224098 | A1* | 10/2005 | Fujii | A47L 15/44 134/26 |
| 2009/0119849 | A1 | 5/2009 | Hill et al. | |
| 2011/0174346 | A1 | 7/2011 | Kessler et al. | |
| 2016/0220094 | A1 | 8/2016 | Durham et al. | |
| 2018/0171530 | A1 | 6/2018 | Hendrickson et al. | |
| 2018/0214003 | A1 | 8/2018 | Krische et al. | |
| 2018/0344126 | A1 | 12/2018 | Minde et al. | |
| 2020/0237179 | A1 | 7/2020 | Haegermarck et al. | |
| 2020/0397213 | A1 | 12/2020 | Kwon | |

FOREIGN PATENT DOCUMENTS

| | | | |
|---|---|---|---|
| DE | 2508730 | A1 | 9/1976 |
| DE | 20311433 | U1 | 12/2003 |
| DE | 19841110 | B4 | 10/2009 |
| EP | 0545127 | A1 | 11/1992 |
| EP | 1703012 | A2 | 9/2006 |
| EP | 1849907 | A1 | 10/2007 |
| EP | 1929920 | A1 | 6/2008 |
| EP | 2138088 | A1 | 12/2009 |
| EP | 2404538 | A1 | 1/2012 |
| EP | 2923627 | A1 | 9/2015 |
| EP | 3069648 | A1 | 9/2016 |
| EP | 3598931 | A1 | 1/2020 |
| GB | 1134483 | | 11/1968 |
| GB | 1521760 | | 8/1978 |
| GB | 2321590 | A | 8/1998 |
| JP | 2000210243 | A | 8/2000 |
| JP | 2000300498 | A | 10/2000 |
| JP | 2009082393 | A | 4/2009 |
| JP | 4675287 | B2 | 4/2011 |
| KR | 19980033950 | U | 9/1998 |
| WO | 2006069827 | A1 | 7/2006 |
| WO | 2009083576 | A1 | 7/2009 |
| WO | 2016075644 | A1 | 5/2016 |
| WO | 2017036513 | A1 | 3/2017 |
| WO | 2018036630 | A1 | 3/2018 |
| WO | 2018099671 | A1 | 6/2018 |
| WO | 2019156503 | A1 | 8/2019 |
| WO | 2020126044 | A1 | 6/2020 |

OTHER PUBLICATIONS

International Search Report and Written Opinion for International Application No. PCT/EP2019/063279, dated Jan. 28, 2020, 10 pages.
International Search Report for International Application No. PCT/EP2018/067037, dated Sep. 24, 2018, 3 pages.
Written Opinion for International Application No. PCT/EP2018/067037, dated Sep. 24, 2028, 6 pages.
Non Final Office Action for U.S. Appl. No. 17/414,517, dated Jul. 20, 2023, 14 pages.
Chinese Office Action dated Mar. 12, 2024 of corresponding Chinese Patent Application No. 201980096660.5.
European Patent Office, European Application No. 19726650.5, Examination Report dated May 13, 2024, 8 pages.

* cited by examiner

DISHWASHER WITH IMPROVED DETERGENT DISPENSER

This application is a U.S. National Phase application of PCT International Application No. PCT/EP2019/063279, filed May 23, 2019, which is incorporated by reference herein.

TECHNICAL FIELD

The invention relates to a dishwasher. In particular the present invention relates to a dishwasher having a detergent dispenser.

BACKGROUND

Dishwashers typically have detergent dispensers that are arranged on the inner wall of the door of the dishwasher. The detergent dispensers are containers provided with a lid that typically is automatically opened during washing so as to output the detergent for washing crockery.

Detergent tablets can often be used for washing crockery. The tablet is inserted manually into the detergent dispenser and, after the lid connected to the detergent dispenser is opened, falls into a zone of the dishwasher in which the washing water dissolves the tablet to wash the crockery.

However, the tablet, after the lid is opened, often does not fall into a zone of the dishwasher that is suitable for the complete dissolution thereof. Thus, at the end of the washing step, the tablet is not completely dissolved, with unpleasant consequences due to the poor washing of the crockery.

EP2138088 describes a detergent dispenser where the tablet is prevented from falling into the dishwasher by a grille or by two vertical elements.

Also, other types of detergents can be used such as gel pads, powder or some other type.

There is a constant desire to improve the dishwashers and to make the washing in dishwashers more efficient. Hence, there is a need for a dishwasher that improves upon how detergent tablets and other types of detergents are dissolved during dishwashing in a dishwasher.

SUMMARY

It is an object of the present invention to provide an improved dishwasher and in particular an improved dishwasher having a detergent dispenser.

These objects and or others are obtained by a detergent dispenser for a dishwasher and a dishwasher as set out in the appended claims.

In accordance with the present invention, a dishwasher comprising a pump for pumping water is provided. A water conduit is provided in the dishwasher connected to the water pump for distributing water in the dishwasher. The dishwasher further comprises a door for closing and opening the dishwasher. The dishwasher has a detergent dispenser located on the inside of the door and the detergent dispenser comprises a closeable cavity for receiving a detergent. The detergent dispenser comprises an outlet for draining fluid from the closable cavity. The detergent dispenser of the dishwasher further comprises a sealed dispenser water inlet configured to be detachably connected to the water conduit upon opening and closing the door. Hereby pressurized water can be directed directly to the inside of the detergent dispenser when the detergent dispenser is in a closed state. This will in turn allow the detergent to be dissolved in a shorter time and more predictably compared to existing mechanisms for emptying detergent from a detergent dispenser.

In accordance with one embodiment, a diffuser is located at the sealed dispenser water inlet to spray pressurized water inside the cavity. Hereby water can be directed to detergent placed inside the cavity. Also, the speed of the water can be increased using the diffuser to allow for a quicker dissolving of the detergent inside the cavity.

In accordance with one embodiment, the water inlet is located at a level above an outlet from the cavity. Hereby water can pass through the cavity under the force of gravity.

In accordance with one embodiment, the detergent dispenser comprises a siphon provided between the closable cavity and the outlet (37). Hereby a fluid detergent can be used in the cavity such that the fluid detergent only exits the detergent dispenser when water is flushed through the detergent dispenser.

In accordance with one embodiment, an overflow outlet is provided at a level above the outlet in the closable cavity. Hereby it can be ensured that water always can exit the detergent dispenser even if the outlet from the dispenser should become clogged or pressure for some other reason should rise inside the cavity.

In accordance with one embodiment, the water inlet is provided with a sealed connector to connect to the water conduit. Hereby an easy to use connection between the water inlet and the water conduit can be implemented.

In accordance with one embodiment, the dishwasher further comprises a controller configured to control water supply in the dishwasher, the controller being configured to supply a dash of pressurized water to the detergent dispenser at a first washing or rinsing phase of a dishwasher program. Hereby a small amount of water can be supplied to the cavity of the detergent dispenser. The small amount of water can soak the detergent before being flushed out from the cavity. This can help dissolving the detergent and provide for a more efficient emptying of detergent from the cavity. The dash of water can be less than a pre-determined amount such as less than 50 ml. In particular, the dash of water is equal or less than the volume of the closeable cavity of the detergent dispenser. Also, the first washing or rinsing phase can be before a main washing phase of a dishwasher program.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. Some components can be omitted from different embodiments. Like numbers refer to like elements throughout the description.

Figure 1:
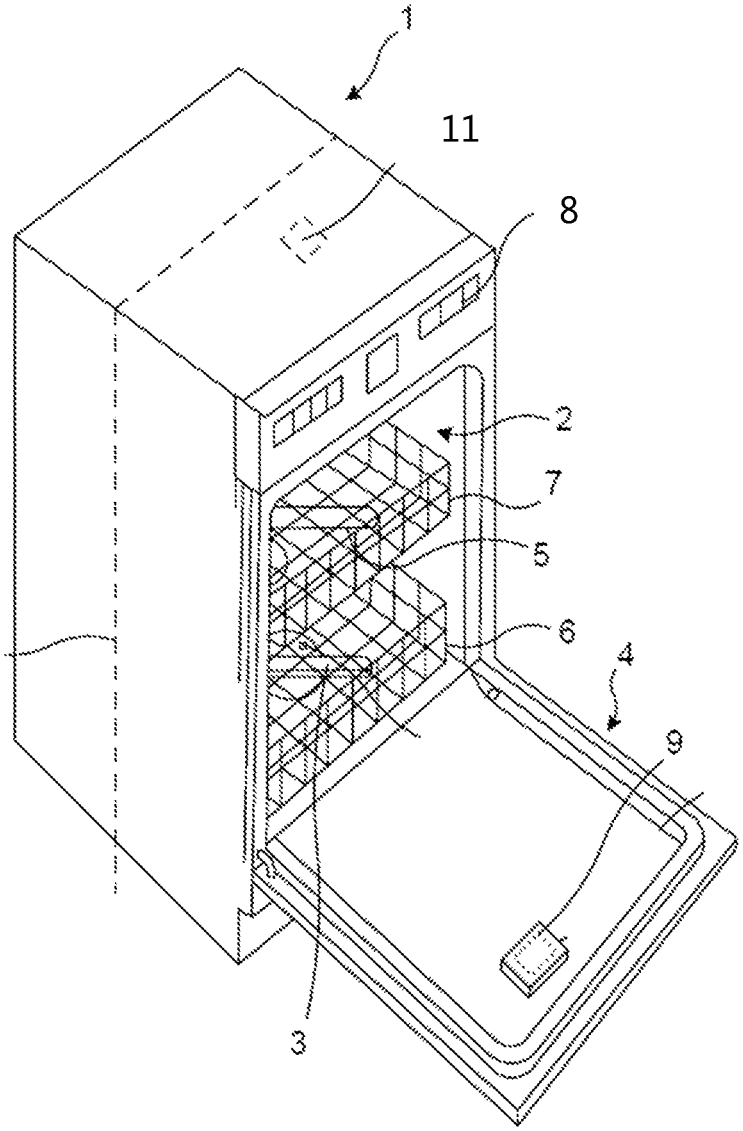
FIG. 1 is a view of a dishwasher.

In FIG. 1, a dishwasher 1 is shown. The exemplary dishwasher 1 comprises a washing compartment or tub 2, a door 4 configured to open and also to close and seal the washing compartment 2, a spraying system having a lower spray arm 3 and an upper spray arm 5, a lower rack 6 and an upper rack 7. Additionally, it may comprise a specific top rack for cutlery (not shown). A controller 11 such as a microprocessor can typically be arranged in the interior of the dishwasher for controlling washing programs and water supply. The controller 11 is typically communicatively connected to an interface 8 via which a user can select washing programs.

The door 4 of the exemplary dishwasher 1 of FIG. 1 is further on its inside arranged with a detergent dispenser 9. The dispenser 9 can typically be opened and closed for placing detergent therein. When leaving the detergent dispenser 9, the detergent will enter into the tub 2. The detergent placed in the detergent dispenser 9 can be any type of detergent such as a detergent tablet or similar can be placed. The term detergent tablet used herein refers to any type of unit with detergent such as a detergent pad or a detergent capsule or similar. However, the invention is not limited to the use of detergent tablets, but any type of detergent such as a gel or powder could be used in the detergent dispenser 9.

Figure 2:
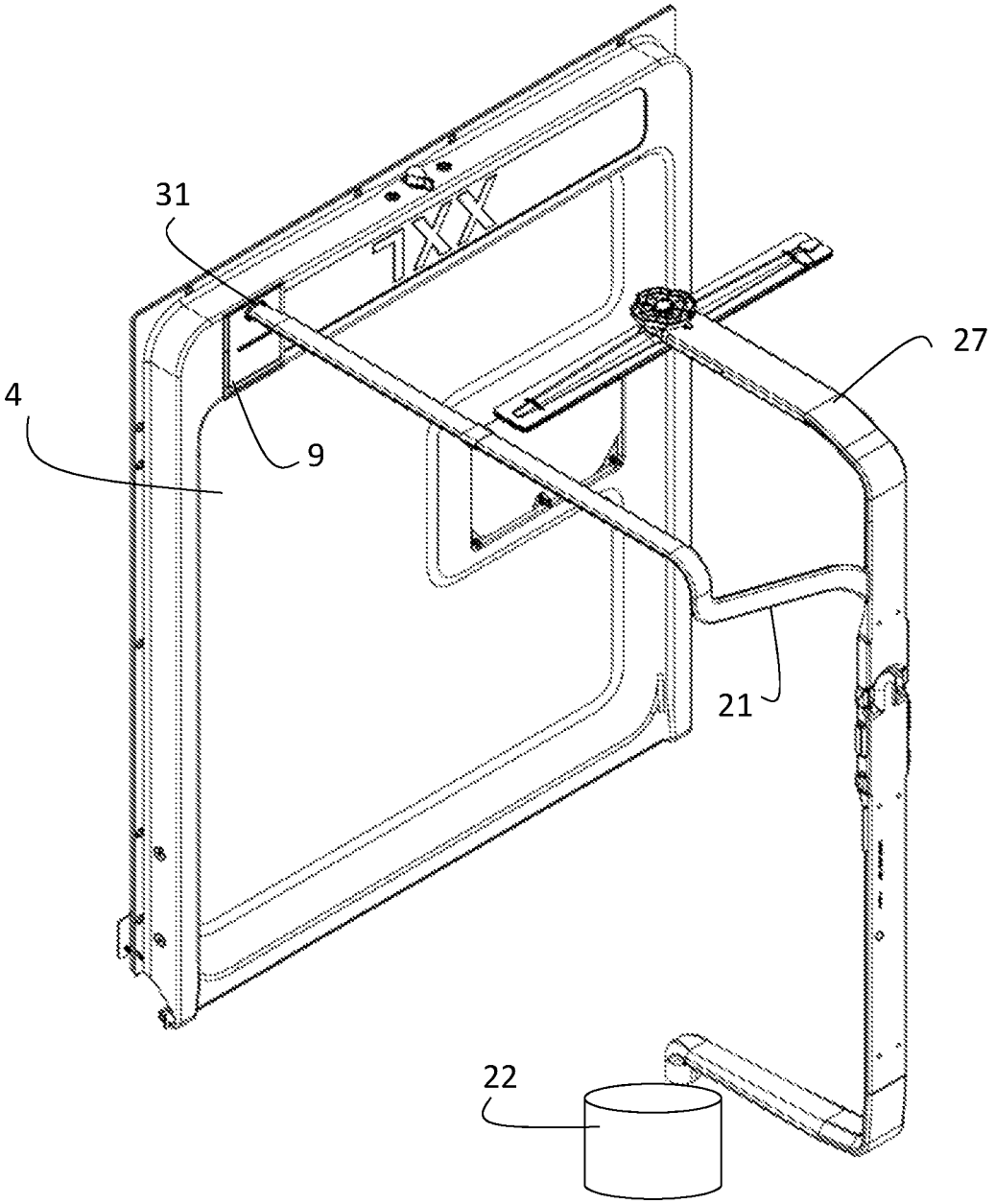
FIG. 2 is a view of an arrangement for supplying water to a detergent dispenser of a dishwasher.

In FIG. 2, a partial view from inside the tub 2 is depicted viewing the door 4 with the detergent dispenser 9. The detergent dispenser 9 can be supplied with water via a water conduit 21. The water conduit 21 is connected to a water pump 22 used for distributing water in the dishwasher. The detergent dispenser 9 has a closeable cavity for receiving a detergent. The detergent dispenser 9 comprises a sealed dispenser water inlet 31 configured to be detachably connected to the water conduit 21 upon opening and closing the door. The sealed dispenser water inlet 31 is configured to provide a sealed connection to the water conduit 21 such that pressurized water can be provided directly to the inside of the detergent dispenser. In other words, the sealed dispenser water inlet 31 can connect with a sealed connection to the water conduit 21. The sealed dispenser water inlet 31 can be located on a side of the detergent dispenser 9 facing the inside of the tub 2. The sealed dispenser water inlet 31 can be provided with a diffuser or a nozzle to direct the pressurized water to the detergent to be dissolved. In other words, in order to boost the dissolution of the detergent, the sealed dispenser water inlet 31 can be configured to direct the water flow directly to the location where detergent is to be placed. This can be particularly advantageous when the detergent is in the form of a tablet. The water conduit 21 can in accordance with some embodiments be a dedicated water conduit 21 directly connecting the detergent dispenser with pressurized water from the water pump 22. In another embodiment the water conduit 21 can be branched off from another water conduit 27 such a water conduit supplying water to a spray arm or some other part of the dish washer supplied with water. When a dedicated water conduit 21 is used a flow controller (not shown) can be used to determine when water is to be supplied to the detergent dispenser 9 by controlling the water supplied to the dedicated water conduit 21.

When the water conduit 21 is branched off some other water conduit 27 a valve (not shown) or similar can be used to control the water supplied to the detergent dispenser 9. In accordance with some embodiments, the valve can be omitted when the water conduit 21 is branched off another water conduit 27 water is then simply provided to the detergent dispenser when water is supplied to the water conduit from which the water conduit 21 is branched off.

Figure 3A:
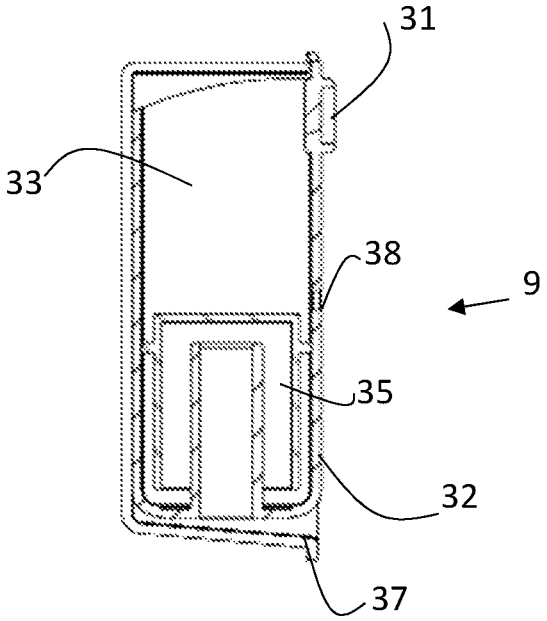
FIGS. 3*a*-3*c* are a cross-sectional views of a detergent dispenser.
Figure 3B:
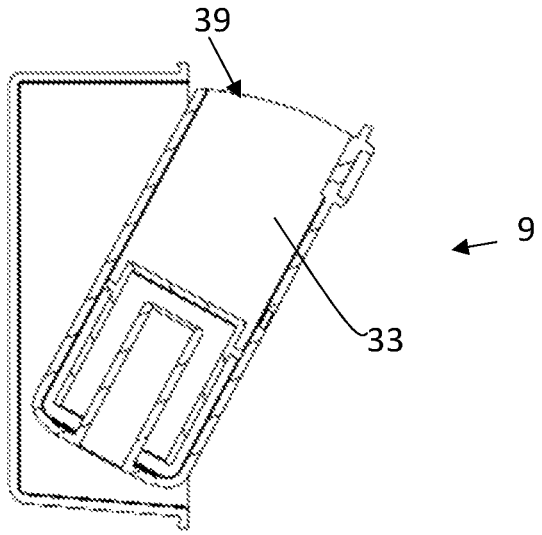

In FIG. 3*a*, a cross sectional side view of a detergent dispenser 9 in accordance with a first embodiment is shown. The detergent dispenser 9 in FIG. 3*a* is shown in a closed position. The detergent dispenser 9 comprises a cavity 33 in which detergent can be placed. The cavity 33 is enclosed by a casing 32. The cavity 33 in the casing 32 can be accessed by for example tilting the casing as is shown in FIG. 3*b* or for example via a lid. Water can be supplied to the cavity 33 via the sealed dispenser water inlet 31. The detergent dispenser further comprises a water outlet 37.

Also, a siphon 35 can be arranged inside the detergent dispenser 9 such that water entering the sealed dispenser water inlet 31 has to pass the siphon 35 to exit the detergent dispenser 9 via the water outlet 37. The siphon 35 can typically be a tube-like structure forcing the water, under the pull of gravity, to flow upwards and then downwards to discharge via the water outlet 37. The use of a siphon can allow for use of liquid/gel detergent that otherwise could exit the detergent dispenser before a main washing cycle in the dishwasher.

Further an overflow outlet 38 can be arranged in the detergent dispenser 9. The overflow outlet 38 will allow water not able to exit the detergent dispenser 9 via the water outlet 37 to leave the detergent dispenser 9 without building a high pressure inside the detergent dispenser 9. The overflow outlet 38 can for example be placed on the side of the detergent dispenser facing the inside of the tub 2. In accordance with some embodiments the overflow outlet 38 is located at a level above the top portion of the siphon 35, when a siphon 35 is present inside the detergent dispenser 9.

In FIG. 3*b*, a cross sectional side view of a detergent dispenser 9 in accordance with the first embodiment is shown with the detergent dispenser 9 shown in an opened position. While the detergent dispenser 9 for the most time is in the closed position when the dishwasher is in use, the detergent dispenser 9 can also be opened for e.g. placing detergent in the cavity 33. In accordance with the embodiment of FIG. 3*b* the detergent dispenser 9 is opened by a tilting mechanism allowing access to the cavity 33 via a top opening 39. Other mechanisms for accessing the cavity 33 can for example be provision of a lid on the detergent dispenser 9.

Figure 3C:
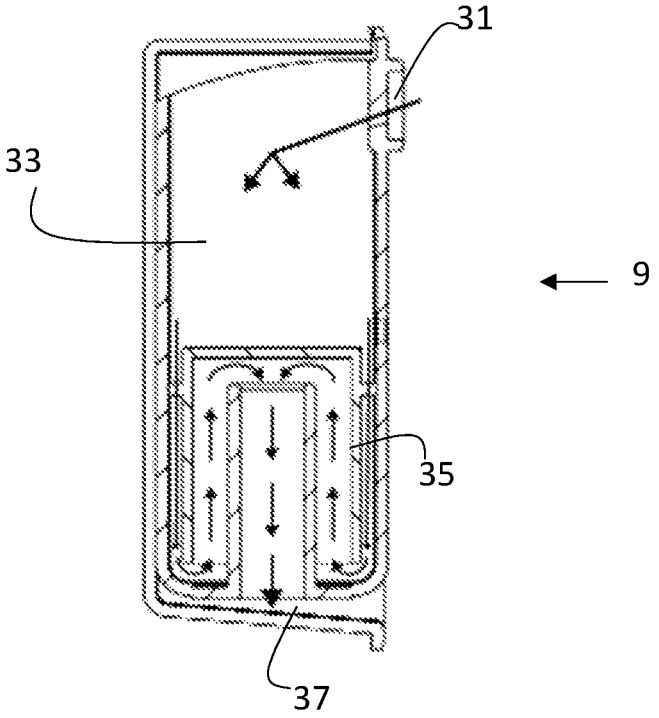

In FIG. 3*c*, a cross sectional side view of a detergent dispenser 9 in accordance with the first embodiment is shown illustrating the water flow in the detergent dispenser 9. The arrows inside the detergent dispenser 9 illustrate water flow. Thus, pressurized water enters the detergent dispenser 9 at the sealed dispenser water inlet 31. Water is then flushed inside the cavity 33 where a detergent can be placed. From the cavity 33 water can in accordance with some embodiments flow via a siphon 35 where water can be configured to upwards and then downwards. The water can then exit the detergent dispenser via a water outlet 37.

Figure 4:
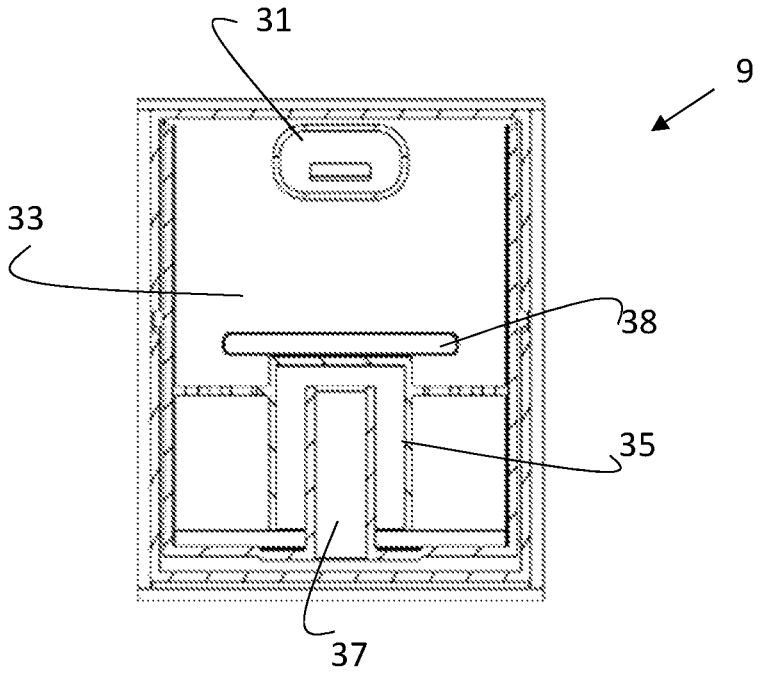
FIG. 4 is a front view of a detergent dispenser.

In FIG. 4 a cross-sectional front view of a detergent dispenser 9 in accordance with the first embodiment is shown. During operation of the dishwasher water can be controlled to be fed to the detergent dispenser 9. Typically, water can be flushed into the detergent dispenser 9 during a main dishwasher cycle when detergent is to be flushed out into the tub 2 of the dishwasher 1. To facilitate flushing the detergent into the tub 2 during the main washing cycle a dash of water can be supplied to the detergent dispenser at a first phase that typically at the start of the washing machine or at least before the start of the main cycle of the dishwasher. Hereby the detergent that can be in the form of a tablet or a gel pad will be soaked early during the operation of the dishwasher and the detergent will be easier dissolved when water is flushed into the detergent dispenser during the main cycle of the dishwasher program. The amount of water in the dash of water should be small. In particular it should be set small enough to not let any detergent into the tub before the main cycle of the dishwasher. For example, the dash of water is less than 100 ml or less than 50 ml. In accordance with some embodiments the dash of water is equal or less than the volume of the closeable cavity 33 of the detergent dispenser 9. In accordance with some embodiment the dash of water is set to an amount such that no water exits the detergent dispenser before the main cycle dishwasher. In such an embodiment water will enter the sealed dispenser water inlet 31 and soak the detergent in the cavity 33 but all water entering the cavity will stay in the detergent dispenser due to the siphon 35 keeping some water in the detergent dispenser until more water is supplied to the detergent dispenser during the main cycle of the dishwasher.

Figure 5:
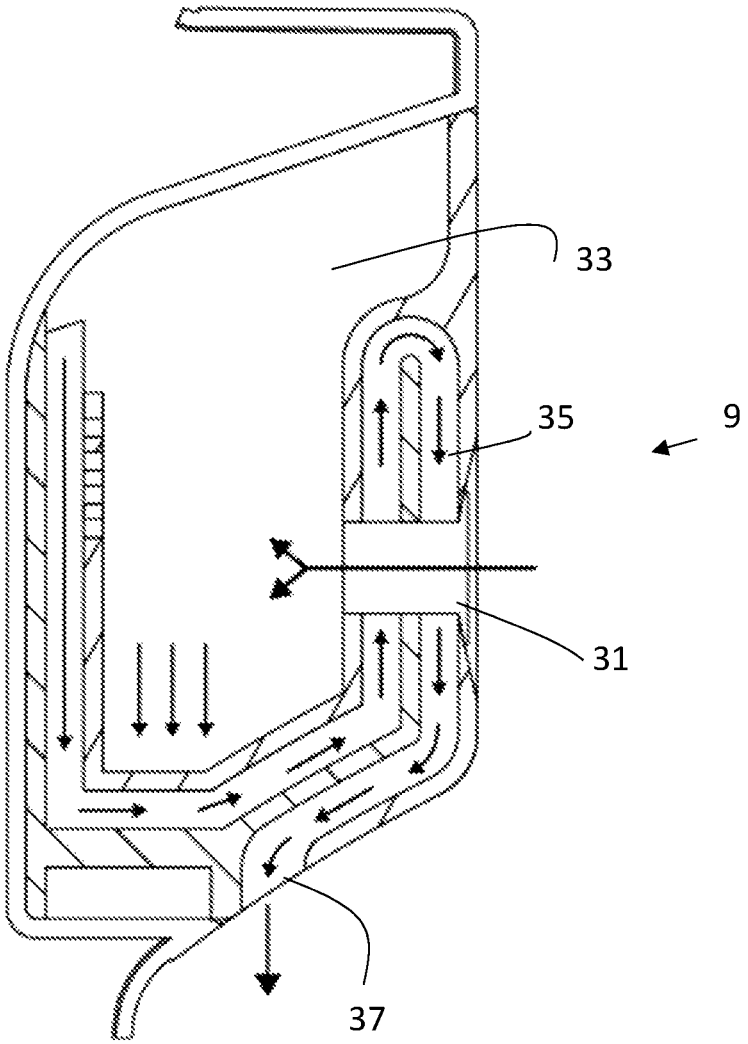
FIG. 5 is a cross sectional view of a detergent dispenser according to a second embodiment.

In FIG. 5 a detergent dispenser 9 in accordance with a second embodiment is depicted. The arrows in the detergent dispenser illustrate water flow inside the detergent dispenser 9 when water flows through the detergent dispenser from the sealed dispenser water inlet 31 via the cavity 33 to the siphon 35 and out via the water outlet 37. The detergent dispenser 9 according to the second embodiment is similar to the detergent dispenser 9 according to the first embodiment. The detergent dispenser according to the second embodiment has the sealed dispenser water inlet 31 configured at a lower level such that the siphon 35 is allowed to have an upper level above the level of the sealed dispenser water inlet 31.

Figure 6A:
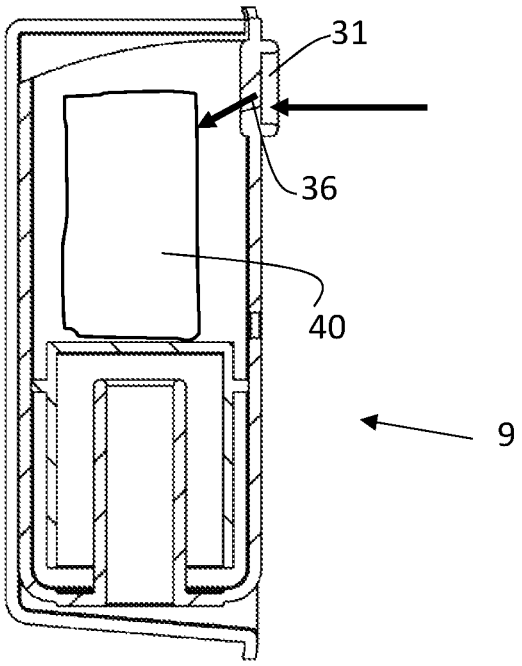
FIGS. 6*a*, 6*b* and 6*c* illustrate two different embodiments of a diffuser at the water inlet of a detergent dispenser.
Figure 6B:
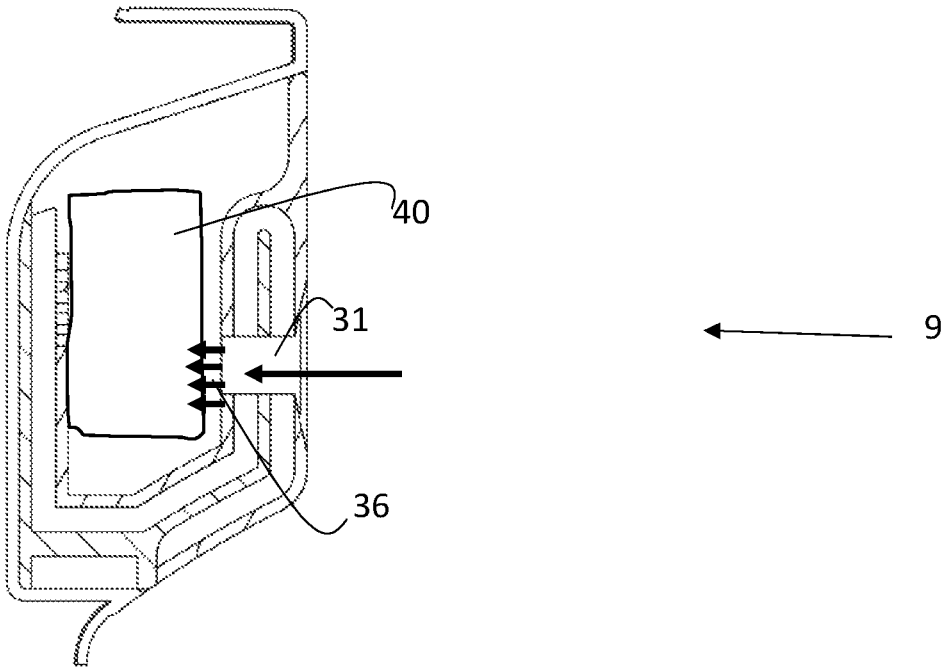

FIGS. 6*a* and 6*b* illustrate two different embodiments of a diffuser 36 at the sealed dispenser water inlet 31 of a detergent dispenser 9. The diffuser is configured to increase the water speed of the water entering the closed cavity of the detergent dispenser. The diffuser can also be configured to direct the pressurized water to a position inside the closable cavity where the detergent is located. In the embodiment shown in FIG. 6*a*, which is a cross-sectional view from the side of the detergent dispenser 9, the diffuser 36 has a funnel-like design in order to reduce the size of the delivery tube to increase the water speed that will hit the detergent, here a detergent tablet 40. Increasing the speed of the water directed at the detergent will improve the dissolution of the detergent. In the embodiment of FIG. 6*a*, the sealed dispenser water inlet 31 is located at the top section of the detergent dispenser 9. The diffuser 36 is directing the water in a downward direction to hit the detergent tablet 40.

FIG. 6*b* shows an alternative embodiment of the detergent dispenser 9 in a cross-sectional view from the side. In the embodiment shown in FIG. 6*b*, the diffuser 36 has a cross-like design configured to split the water flow in a number of different sub-flows. Here four sub-flows are shown, but more or fewer can also be used.

The flows have a reduced the size to increase the water speed that will hit the detergent tablet 40. In other words, the diffuser can be configured to increase the speed of the water at the sealed dispenser water inlet 31.

Figure 6C:
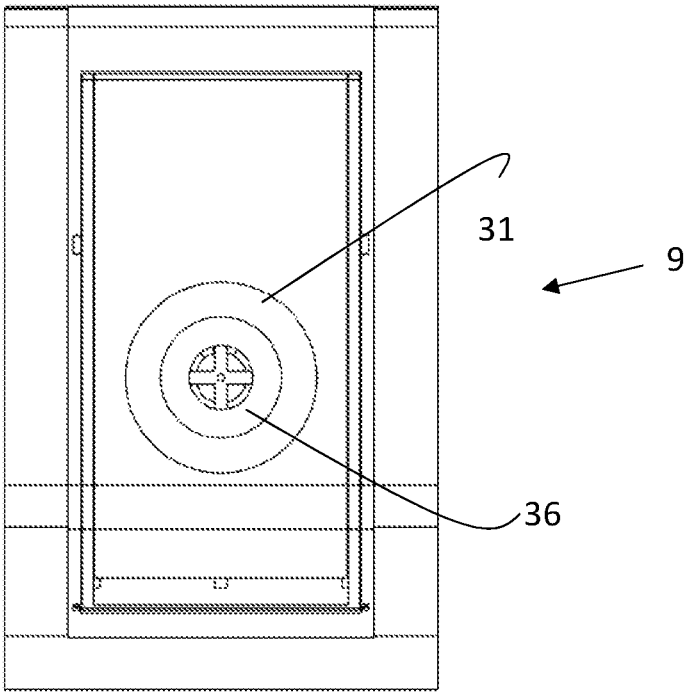

FIG. 6*c* shows the embodiment shown in FIG. 6*b* in another view. In FIG. 6*c* the detergent dispenser 9 is shown in a front view. As can be seen, the water flow entering the dispenser via the sealed dispenser water inlet 31 will be made to pass the diffuser 36. The diffuser 36 has a cross like-design configured to split the water flow into multiple sub-flows. Hence, the water flow entering the detergent dispenser 9 is split into multiple sub-flows where the sub-flows have an increased speed compared to the main water flow entering the detergent dispenser 9.

The invention claimed is:

1. A dishwasher comprising:

a tub;

a pump configured to pump water;

a water conduit connected to the pump and configured to convey the water upon operation of the pump;

a door movable between an open position in which the tub is opened, and a closed position in which the tub is closed by the door; and a detergent dispenser located on a side of the door facing the tub when the door is in the closed position, the detergent dispenser comprising a closeable cavity configured to receive a detergent, an outlet configured to drain fluid from the closable cavity to the tub, and a sealed dispenser water inlet configured to be detachably fluidly connected to the water conduit when the door is in the closed position, wherein a diffuser is located at the sealed dispenser water inlet and configured to spray pressurized water inside the cavity upon operation of the pump.

2. The dishwasher according to claim 1, wherein the water inlet is located at a level above the outlet.

3. The dishwasher according to claim 1, wherein the detergent dispenser comprises a siphon provided between the closable cavity and the outlet.

4. The dishwasher according to claim 1, wherein the closable cavity comprises an overflow outlet at a level above the outlet.

5. The dishwasher according to claim 1, wherein the water inlet comprises a sealed connector configured to connect to the water conduit.

6. The dishwasher according to claim 1, further comprising a controller configured to control water supply in the dishwasher, the controller being configured to:

supply a dose of pressurized water to the detergent dispenser at a first washing or rinsing phase of a dishwasher program.

7. The dishwasher according to claim 6, wherein the dose of water is less than 50 milliliters.

8. The dishwasher according to claim 6, wherein the dose of water is equal or less than a volume of the closeable cavity.

9. The dishwasher according to claim 6, wherein the controller is configured to perform a main washing phase of the dishwasher program after the first washing or rinsing phase.

10. A dishwasher comprising:

a tub;

a pump;

a water conduit connected to the pump and configured to convey water upon operation of the pump;

a door movable between an open position in which the tub is opened, and a closed position in which the tub is closed by the door;

a detergent dispenser located on a side of the door facing the tub when the door is in the closed position, the detergent dispenser comprising a closeable cavity configured to receive a detergent, an outlet configured to drain fluid from the closable cavity to the tub, and a sealed dispenser water inlet configured to be detachably fluidly connected to the water conduit when the door is in the closed position; and a diffuser located at the sealed dispenser water inlet and configured to increase the velocity of the water entering the closeable cavity upon operation of the pump.

11. The dishwasher of claim 10, wherein the water inlet is located at a level above the outlet.

12. The dishwasher of claim 10, wherein the detergent dispenser comprises a siphon provided between the closable cavity and the outlet.

13. The dishwasher of claim 10, wherein the closable cavity comprises an overflow outlet at a level above the outlet.

14. The dishwasher of claim 10, further comprising a controller configured to control water supply in the dishwasher, the controller being configured to:

supply a dose of pressurized water to the detergent dispenser at a first washing or rinsing phase of a dishwasher program.

15. A dishwasher comprising:

a tub;

a pump configured to pump water;

a water conduit connected to the pump and configured to convey the water upon operation of the pump;

a door movable between an open position in which the tub is opened, and a closed position in which the tub is closed by the door; and a detergent dispenser located on a side of the door facing the tub when the door is in the closed position, the detergent dispenser comprising a closeable cavity configured to receive a detergent, an outlet configured to drain fluid from the closable cavity to the tub, a sealed dispenser water inlet configured to be detachably fluidly connected to the water conduit when the door is in the closed position, and a siphon disposed between the closeable cavity and the outlet such that water entering the detergent dispenser via the sealed dispenser water inlet has flow upwards and then downwards before exiting the detergent dispenser via the outlet, wherein a diffuser is located at the sealed dispenser water inlet and configured to spray pressurized water inside the cavity upon operation of the pump.

16. The dishwasher of claim 15, further comprising a controller configured to control water supply in the dishwasher, the controller being configured to:

supply a dose of pressurized water to the detergent dispenser at a first washing or rinsing phase of a dishwasher program.

17. The dishwasher of claim 16, wherein the dose of water is less than 50 milliliters.

18. The dishwasher of claim 16, wherein the dose of water is equal or less than a volume of the closeable cavity.

19. The dishwasher of claim 15, wherein the water inlet is located at a level above the outlet.

* * * * *